United States Patent [19]

Iizuka et al.

[11] 3,973,404

[45] Aug. 10, 1976

[54] LOW PRESSURE TURBINE INSTALLATION

[75] Inventors: Nobuyuki Iizuka; Katsukuni Hisano; Satoshi Ninomiya; Yasuhiko Otawara, all of Hitachi, Japan

[73] Assignee: Hitachi, Ltd., Japan

[22] Filed: Jan. 21, 1975

[21] Appl. No.: 542,820

[30] Foreign Application Priority Data

Jan. 23, 1974 Japan ..... 49-9323

[52] U.S. Cl. ..... 60/693; 415/101; 415/103

[51] Int. Cl.[2] ..... F01K 11/02

[58] Field of Search ..... 415/101, 102, 103; 60/689, 690, 692, 693

[56] References Cited

UNITED STATES PATENTS

| | | | |
|---|---|---|---|
| 1,298,206 | 3/1919 | Herr | 415/102 |
| 1,310,680 | 7/1919 | Sherbondy | 415/102 |
| 1,372,929 | 3/1921 | Baumann et al. | 60/393 |
| 1,405,090 | 1/1922 | Baumann | 415/102 |
| 1,405,565 | 2/1922 | Baumann | 60/693 |
| 2,181,751 | 11/1939 | Warren | 415/103 |
| 2,603,953 | 7/1952 | Wilson | 60/693 |

FOREIGN PATENTS OR APPLICATIONS

| | | | |
|---|---|---|---|
| 1,044,197 | 11/1953 | France | 415/102 |
| 542,191 | 12/1941 | United Kingdom | 415/103 |

*Primary Examiner*—C. J. Husar
*Attorney, Agent, or Firm*—Craig & Antonelli

[57] ABSTRACT

Low pressure turbine installation comprising a casing, at least two groups of turbine stages mounted in said casing, each turbine stage having blades so arranged that a flow of steam passes through the respective turbine stages in contraflow manner, partition means in said casing for separating the opposed final stages of said turbine stages from each other, and steam exhausting means opened in the side walls of said casing in a direction substantially perpendicular to the axis of said turbine, said steam exhausting means being connected to condensers.

5 Claims, 9 Drawing Figures

LOW PRESSURE TURBINE INSTALLATION

BACKGROUND OF THE INVENTION

The present invention relates to a low pressure turbine installation in which flows of steam are passed therethrough in contraflow manner and exhausted laterally of said turbine.

In the past, a flow of steam which has worked in a high pressure turbine is introduced into the central portion of a low pressure turbine in which the flow of steam is divided into two flow portions to be worked in right and left-hand low pressure turbine sections. The flow portions which have worked in the respective turbine sections above-mentioned are exhausted into a condenser located below the low pressure turbine. In such case, there is a space below the low pressure turbine through which no flow of steam passes because of dividing the flow of steam introduced from the central portion of the low pressure turbine into the two right and left-hand flow portions. These flow portions produce some vortexes within the above-mentioned space so that loss of pressure will be developed to decrease the turbine efficiency of the low pressure turbine. Also, the above-mentioned space will require a larger size of condenser than necessary for the turbine.

In order to avoid such large size of condenser, a low pressure turbine has been proposed with condensers in both sides of the casing thereof. However, this low pressure turbine also introduces flow of steam into its central portion and divides the flow of steam into right and left-hand flow portions so that the same space as aforementioned will be produced adjacent the central portion of the low pressure turbine to develop vortexes of steam within the space.

SUMMARY OF THE INVENTION

One object of the present invention is to provide a low pressure turbine in which there is no turbulence in exhausted flow of steam so that the decrease of turbine efficiency can be effectively prevented.

Another object of the present invention is to provide a low pressure turbine in which the turbine casing is effectively employed to provide smaller size of the overall construction.

Another object of the invention is to provide a low pressure turbine installation which enables the size of the turbine house to be reduced by keeping at a low level the height of turbine foundation on which the turbine casing is supported.

The present invention provides a low pressure turbine installation comprising a first group of turbine stages consisting of a plurality of stages mounted in a turbine casing and disposed such that a stream of fluid flows from the high pressure side to the low pressure side; a second group of turbine stages consisting of a plurality of stages also mounted in the turbine casing and supported by the same rotary shaft as the first group of turbine stages, the second group of turbine stages being disposed such that another stream of fluid branching from the stream of fluid flows from the high pressure side to the low pressure side so that the two streams of fluid flow countercurrently to each other; condensers arranged on opposite sides of the turbine casing such that the condensers have substantially the same height as the turbine casing; exhausting openings at opposite sides of the turbine casing for venting fluid therethrough after the fluid has moved through the first group of turbine stages and the second group of turbine stages, the exhausting openings being disposed in a position equal to or higher than the rotary shaft; and a partition wall interposed between the final stages of the first group of turbine stages and the second group of turbine stages which are disposed in spaced juxtaposed relationship, the partition wall extending normal to the rotary shaft and toward the exhausting openings so that the partition wall is effective to prevent the collision of the countercurrents of fluid which have moved through the first group of turbine stages and the second group of turbine stages and to conduct the fluid toward the exhaust openings.

DESCRIPTION OF THE PREFERRED EMBODIMENTS

Prior to the description of the preferred embodiments of the present invention, the prior art will be explained with reference to FIGS. 1 to 5.

Figure 1:
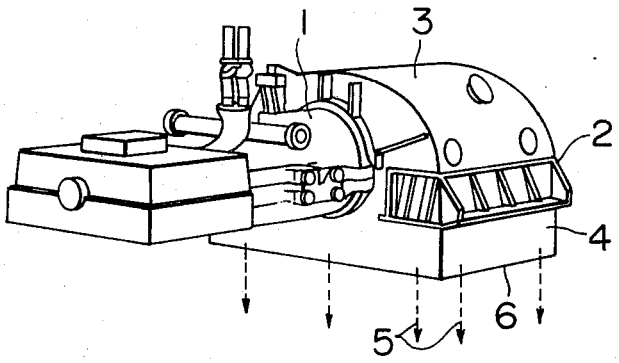
FIG. 1 PRIOR ART
FIG. 1 is a perspective view showing an outline of a prior art steam turbine.
Figure 2:
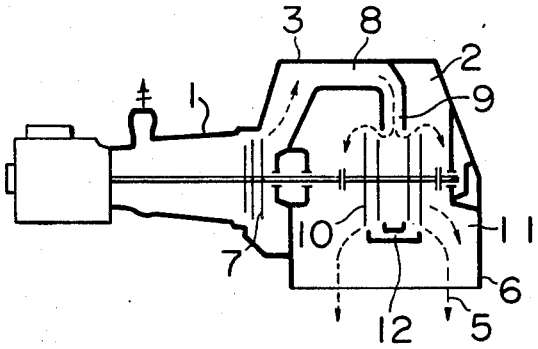
FIG. 2 PRIOR ART
FIG. 2 is a flow diagram of the steam flows in the prior art steam turbine shown in FIG. 1.

Referring to FIGS. 1 and 2, steam which has worked in a high pressure turbine 1 flows into a low pressure turbine 2 to work therein. Thereafter, the steam is exhausted from the lower casing 4 of the low pressure turbine 2 through an exhausting opening 6 therein as shown by a dashed lines 5.

Explaining in more detail with reference to FIG. 2, the flow of steam which has worked on a blade 7 in the final stage of the high pressure turbine 1 enters the low pressure turbine 2 at a steam inlet 9 through a steam communicating chamber 8 defined by an upper casing 3 of the low pressure turbine 2. The flow of steam is then divided into two flow portions to work in the respective turbine wheels. The flow portions leaving the respective final stage blades 10 of the low pressure turbine 2 are exhausted from steam outlets 11 through the exhausting opening 6 into a condenser mounted on the bottom of the turbine casing.

As seen best from FIG. 2, there is a space 12 between two low pressure flow portions of steam through which no flow of steam passes. Within the space 12 are produced vortexes of steam which disturb the flow portions to be exhausted from the low pressure turbine 2 so that pressure loss will be developed to decrease the turbine efficiency. Also, the space 12 requires an exhausting opening 6 of larger size than is required practically for the exhausted flow portions. Consequently, the condenser is required to be of larger size than needed.

In order to avoid such space 12, the exhausting opening 6 may be divided into two opening portions to locate one condenser for each of the opening portions. However, cost in manufacturing will be increased.

Further, the low pressure turbine is provided, in most case, with extracting pipes from which part of the steam is inducted into a feed water heater wherein water supplied to a boiler is heated. The extracting pipes must be located below the turbine so as to prevent the moisture within the extracting pipes from reversing into the turbine. When the condenser 13 is mounted on the bottom of the turbine casing as shown in FIG. 3, the extracting pipes 14 becomes passing through the condenser 13 so that the steam current flowing through the condenser 13 will be disturbed, thereby resulting in the decrease of turbine efficiency.

The feed water heater 15 may be located either in the interior or exterior of the condenser 13. Preferably, the feed water heater is provided on the exterior of the condenser. In the latter case, the extracting pipes will pass through the condenser to be drawn outside therefrom so that a portion of the feed water heater is positioned in the interior of the condenser. This may prevent the turbine efficiency from decreasing.

Figure 3:
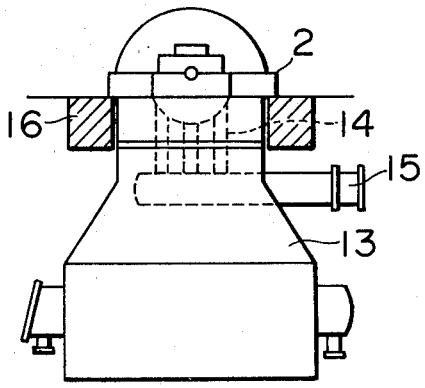
FIG. 3 PRIOR ART
FIG. 3 is a front elevational view, broken partially, showing a condenser mounted on the underside of the prior art steam turbine shown in FIG. 1.

The most important problem encountered in the prior art steam turbine of the type wherein the condenser is located immediately beneath the turbine casing is that the turbine foundation for supporting the low pressure turbine necessarily has a large height as shown in FIG. 3 because of the need to ensure that there is a sufficiently large space to install the condenser, thereby increasing the size of the structure of the turbine casing. This leads to an increase in the size of the turbine house.

Figure 4:
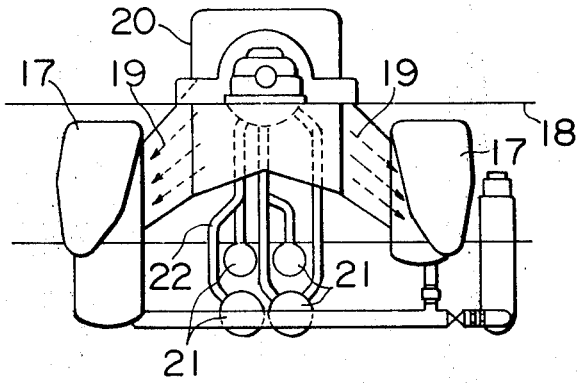
FIG. 4 PRIOR ART
FIG. 4 is a front elevational view showing another prior art steam turbine different from the steam turbine shown in FIG. 1, which has two condensers at the both sides thereof.

In order to solve the various problems aforementioned, there is proposed a low pressure turbine having two condensers mounted on the both sides thereof as shown in FIG. 4. In such arrangement, the condensers 17 are located in a position lower than a supporting surface 18 for a low pressure turbine 20 so that flows of steam will be exhausted downwardly and laterally of the turbine 20. Accordingly, the supporting surface 18 is in a position lower than in the aforementioned low pressure turbine having the condenser mounted on the bottom of the turbine casing. This serves to decrease the constructing expenses of the turbine house. Also, feed water heaters 21 are located below the low pressure turbine 20, and extracting pipes 22 are extended from the bottom of the turbine casing toward the respective feed water heater. Therefore, these extracting pipes 22 never pass through the condensers 17.

Figure 5:
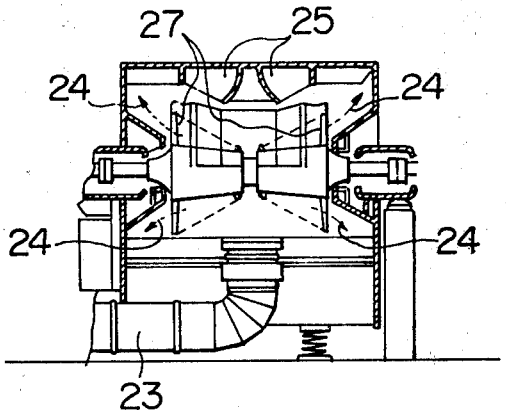
FIG. 5 PRIOR ART
FIG. 5 is a vertically sectional view showing still another prior art steam turbine different from the steam turbine shown in FIG. 4 and illustrating flows of steam within the turbine casing having at its side a condenser.

In such arrangement, as seen best from FIG. 5, flow of steam is supplied to a low pressure turbine through a communicating tube 23. After working in the group of turbine stages of the low pressure turbine, the flow of steam is exhausted therefrom in the opposite directions as shown by dashed lines 24. It is apparent from FIG. 5 that the turbine casing forms spaces 25 which are meaningless for the flows of steam.

The present invention will be now described with reference to FIGS. 6 to 9.

Figure 6:
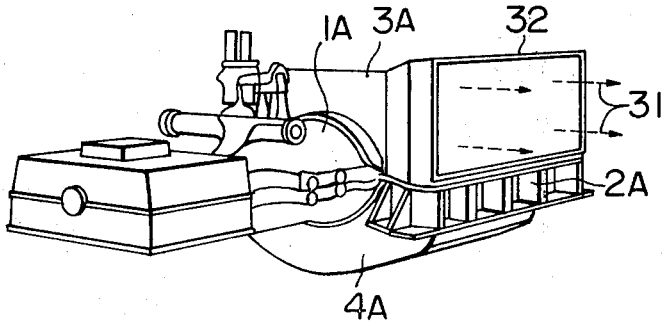
FIG. 6 is a perspective view showing an outline of a steam turbine according to the present invention.
Figure 7:
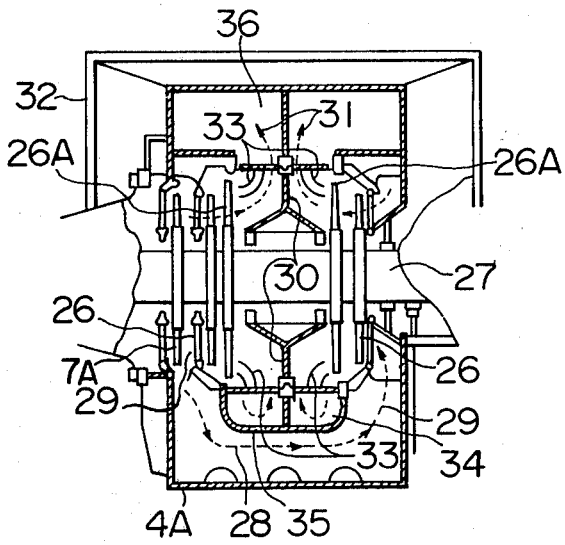
FIG. 7 is a vertically sectional view of the steam turbine shown in FIG. 6, illustrating flows of steam within the turbine casing thereof.
Figure 8:
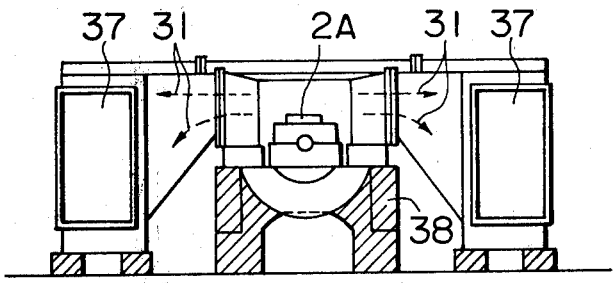
FIG. 8 is a front elevational view, broken partially, showing a condenser mounted on the steam turbine shown in FIG. 6.

Referring to FIGS. 6 to 8, an arrangement according to the present invention includes a high pressure turbine 1A and a low pressure turbine 2A connected operably to the high pressure turbine. The low pressure turbine 2A has a turbine casing consisting of an upper casing portion 3A and a lower casing portion 4A. The low pressure turbine 2A has also a turbine rotor 27 supported rotatably within the turbine casing. The turbine rotor 27 has two groups of turbine stages 26 each consisting of a plurality of rows of blades and arranged along the stream of fluid flowing from the high pressure side to the low pressure side, the two groups of turbine stages being disposed in spaced juxtaposed relationship on the same shaft. Thus the streams of steam flowing through the two groups of turbine stages 26 flow counter-currently to each other. The respective group 26 of turbine stages have steam inlets 29 which are connected with each other by means of a steam passage 28 formed in the lower casing portion 4A. The group 26 of turbine stages include final stage blades 26A, respectively, which turbine stages are separated from each other by means of a partition wall 30 therebetween which is supported by the turbine casing. The partition wall 30 extends normal to the turbine rotor 27 so that the steam flowing through the groups 26 of turbine stages is led to two condensers 37 disposed on opposite sides of the low pressure turbine casing and at substantially the same height as the casing. In this manner, the steam flows 31 emerging from the respective final turbine stages 26A can be prevented from impinging against each other.

The low pressure turbine 2A is provided with steam exhausting openings 32 directed outwardly at the sides of the turbine casing. The exhausting openings 32 open at opposite sides of the turbine casing in a position which is disposed at the same level as or a higher level than the turbine rotor. This enables the steam flowing through the groups of turbine stages to flow into the condensers 37 without much loss in the flow passage. Between the respective final turbine stages 26A and the partition wall 30 there is provided curved guide plates 33 which serve to conduct uniformly and smoothly the steam flows 31 to the steam exhausting openings 32. Each of the final turbine stages 26A is separated from the steam passage 28 by means of a partition plate 35 to form an exhausting passage 34 having an outlet 36. As shown in FIG. 8, condensers 37 are connected with the respective exhausting openings 32. The low pressure turbine 2A is supported by a turbine foundation 38 which has its top surface being of about one half in height as that of the prior art turbine having a condenser located below the turbine casing.

Figure 9:
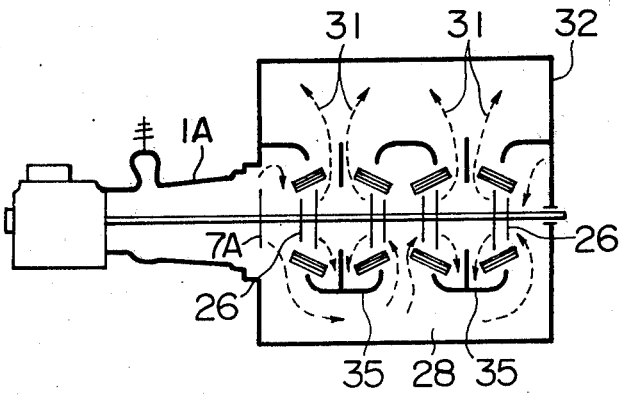
FIG. 9 is a schematic view illustrating a modified steam turbine according to the present invention in which two sets of opposed groups of turbine stages are arranged.

FIG. 9 illustrates a modified low pressure turbine which has the same construction as that of the low pressure turbine shown in FIGS. 6 to 8 except that two sets of opposed groups of turbine stages are arranged in the turbine casing.

In operation, steam having worked in the high pressure turbine 1A is divided into two flow portions at the outlet of the final turbine stages 26A one of which enters directly one of the steam inlets 29, other flow portion being conducted into the other steam inlet 29 through the steam passage 28. These flow portions work in the respective groups of turbine stages in contraflow manner. The flow portions from the final turbine stages 26A are directed to the steam exhausting passage 34 by means of the guide plate 33 and passed through the exhausting opening 32 via the outlet 36 as shown by dashed lines 31 to the condensers 37. In such manner, the steam flow portions are exhausted from the centers of the exhausting openings so that the velocity distribution becomes symmetrical to minimize the development of vortex resulting in the decrease of turbine efficiency. In general, if the center line of steam flow is discontinuous, the vortex may most easily be created. Therefore, the exhausting of the steam from the center of exhausting opening 32 results in the center line of flow coinciding with the center line of said opening 32. This means that the center line of flow becomes to be continuous to minimize the development of vortexes.

Further, the present invention provides such construction that the steam exhausting passage 34 and its outlet 36 are formed in the space which has been meaningless for the prior art turbine so that the turbine casing may be effectively employed according to the present invention. Still further, because it is possible to minimize the height of the turbine foundation on which the turbine casing is supported, the invention enables the size of the turbine foundation to be reduced and hence reduces the size of the turbine house as a whole.

It would be apparent from the foregoing that the present invention provides a low pressure turbine installation employing effectively the turbine casing and preventing the flows of steam from disturbing. According to the present invention, smaller size of low pressure turbine can also be realized.

What we claim is:

1. A low pressure turbine installation comprising:

a low pressure turbine casing;

a first group of turbine stages consisting of a plurality of stages mounted on a rotary shaft in said low pressure casing and disposed such that a stream of fluid flows from the high pressure side to the low pressure side;

a second group of turbine stages consisting of a plurality of stages also mounted in said low pressure turbine casing on said rotary shaft, said second group of turbine stages being disposed such that another stream of fluid branching from said stream of fluid flows from the high pressure side to the low pressure side so that the two streams of fluid flow countercurrently to each other;

condensers arranged on opposite sides of said low pressure turbine casing such that the condensers have substantially the same height as the low pressure turbine casing;

exhausting openings opening at opposite sides of said low pressure turbine casing for venting fluid therethrough after the fluid has moved through said first group of turbine stages and said second group of turbine stages, said exhausting openings being disposed in a position equal to or higher than said rotary shaft;

a partition wall interposed between the final stages of said first group of turbine stages and said second group of turbine stages which are disposed in spaced juxtaposed relationship, said partition wall extending normal to said rotary shaft and toward the exhausting openings so that said partition wall is effective to prevent the collision of the countercurrents of fluid which have moved through the first group of turbine stages and the second group of turbine stages and to conduct the fluid toward the exhaust openings; and an exhaust passage formed between said partition wall and said low pressure turbine casing for the fluid to move therethrough toward the exhaust openings after the fluid has moved through said two groups of turbine stages.

2. A low pressure turbine installation as claimed in claim 1, further comprising a fluid passage formed in said low pressure turbine casing for connecting a first fluid inlet through which fluid is introduced into the first group of turbine stages to a second fluid inlet through which fluid is introduced into the second group of turbine stages.

3. A low pressure turbine installation as claimed in claim 2, further comprising a partition member mounted in said low pressure turbine casing for connecting the final stage of the first group of turbine stages to the final stage of the second group of turbine stages to define said fluid passage between said partition member and said low pressure turbine casing, said partition member also serving to separate said fluid passage from the fluid that has moved through said two groups of turbine stages.

4. A low pressure turbine installation as claimed in claim 2, further comprising a plurality of guide plates disposed in the exhaust passage on the downstream side of the final stage of the first group of turbine stages and the final stage of the second group of turbine stages, said guide plates being normal to said rotary shaft so as to lead to said exhaust openings the fluid which has moved through said two groups of turbine stages.

5. A low pressure turbine installation as claimed in claim 2, further comprising a plurality of curved guide plates disposed in the exhaust passage on the downstream side of the final stage of the first group of turbine stages and the final stage of the second group of turbine stages, said guide plates being normal to said rotary shaft so as to lead to said exhaust openings the fluid which has moved through said two groups of turbine stages.

* * * * *